United States Patent [19]

Davis, Sr.

[11] Patent Number: 4,460,027

[45] Date of Patent: Jul. 17, 1984

[54] LOG SPLITTING DEVICE

[76] Inventor: William E. Davis, Sr., Rte. 1, Box 33, Seven Springs, N.C. 28578

[21] Appl. No.: 419,794

[22] Filed: Sep. 20, 1982

[51] Int. Cl.[3] ..... B27L 1/00

[52] U.S. Cl. ..... 144/194; 144/193 R

[58] Field of Search ..... 144/193 R, 193 A, 193 B, 144/193 C, 193 D, 194, 366

[56] References Cited

U.S. PATENT DOCUMENTS 4,362,194 12/1982 Lawson ..... 144/193 C

FOREIGN PATENT DOCUMENTS 304465 1/1955 Switzerland ..... 144/194

*Primary Examiner*—W. D. Bray

*Attorney, Agent, or Firm*—Mills & Coats

[57] ABSTRACT

This invention is a log splitting device which is easily maneuvered over the log to be split whereupon the spiral, conical shaped splitting member bores into such log to split the same. Reverse or back-out mechanisms are also provided should an extremely knurled or knotted piece of wood be encountered. To accomplish these ends, a frame for a motor and the splitting member is mounted on oversized tires and is counterbalanced to allow even a small woman or child to manuever the same into log splitting position. The logs are split while lying horizontally on the ground thereby eliminating the necessity of having to pick the same up prior to splitting as is common among the prior art splitting systems.

13 Claims, 5 Drawing Figures

LOG SPLITTING DEVICE

FIELD OF INVENTION

This invention relates to wood processing equipment and more particularly to log splitting devices.

BACKGROUND OF INVENTION

With growing scarcity and related spiraling costs of fossil fuels, people in ever increasing numbers turning to renewable sources of heat such as wood burning stoves and fireplaces. To fuel these alternate heat sources, large amounts of wood are required and the larger pieces must be split or otherwise rendered into a size that can be easily handled and will readily ignite and burn.

One of the common methods of rendering larger pieces of wood such as logs into manageable pieces is the splitting of the same. This, of course, can be done by hand using either an ax or a maul and wedge. This is back breaking and time consuming work, however, and when a large amount of wood must be split, alternate mechanical methods have been employed.

The alternate splitting methods mentioned above have included horizontally disposed rails with a hydraulic or similar driven driven ram which includes a splitting block or wedge either mounted thereon or against which the wood is driven. Conical shaped, screw type splitting members have also been employed and are usually horizontally mounted so that the log being split will engage the ground and thus not wildly spin or rotate during the splitting process.

Guillotine type affairs have also been employed with some success but there again they require that the log be placed in splitting position on the device prior to the splitting operation taking place as is common with all of the above-mentioned prior art devices.

BRIEF DESCRIPTION OF INVENTION

After much research and study into the above-mentioned problems, the present invention has been developed to provide an extremely efficient log splitting means which can be readily maneuvered over a log lying horizontally on the ground and can split the same without further movement thereof. Thus it can be seen that the present invention allows logs cut into fireplace or stove lengths to be split where they fall. The end result of this splitting procedure is that it is much easier to pick up and load split pieces of wood than it is to load whole logs on a splitting machine prior to the splitting operation.

In view of the above, it is an object of the present invention to provide a log splitting device which can be maneuvered along a cut up tree lying on the ground and split the same prior to any further loading thereof.

Another object of the present invention is to provide a readily maneuverable splitting device which can be moved into operational position and split a log without prior prepositioning thereof.

Another object of the present invention is to provide a log splitting device which is readily maneuverable above a log and bores down thereinto to split the same while it is lying on the ground.

Another object of the present invention is to provide a vertically disposed log splitting member for engaging a log lying horizontally on the ground.

Another object of the present invention is to provide a relatively inexpensive and yet highly efficient log splitting device which can be readily maneuvered by one person of even small statute from one splitting position to another.

Another object of the present invention is to provide a log splitting device mounted on relatively large sulky type wheels.

Another object of the present invention is to provide a log splitting system which can be readily controlled for boring into and backing out of a log to be split.

Other objects and advantages of the present invention will become apparent and obvious from a study of the following description and the accompanying drawings which are merely illustrative of such invention.

DETAILED DESCRIPTION OF INVENTION

Figure 1:
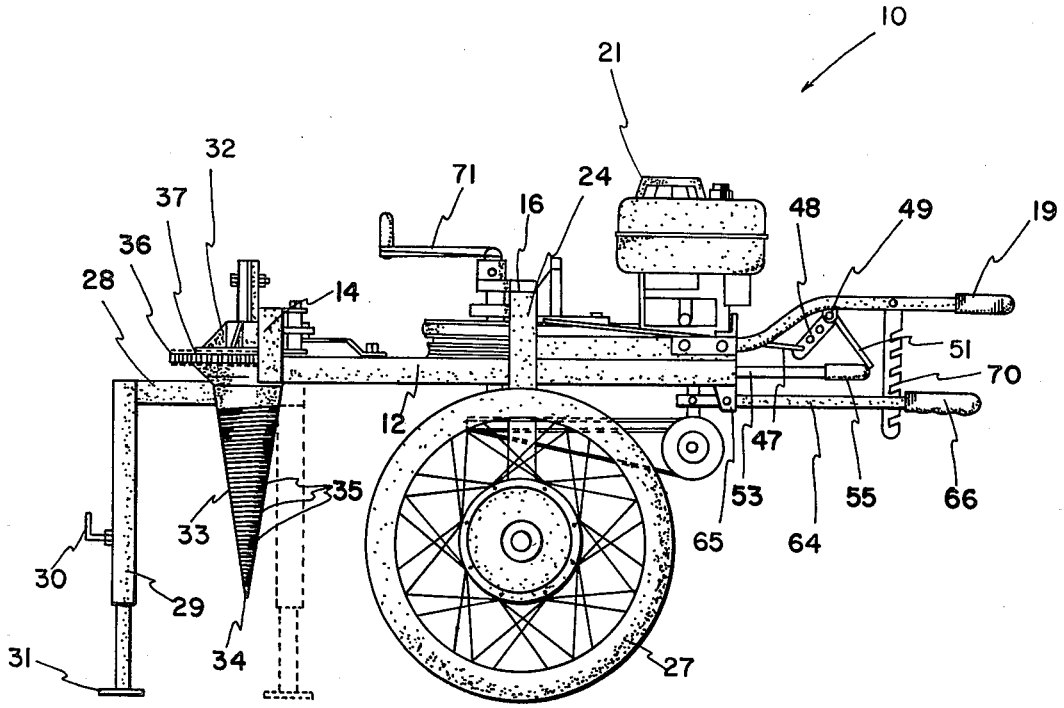
FIG. 1 is a side elevational view of a preferred embodiment of the present invention.

With further reference to the drawings, the improved log splitting device of the present invention, indicated generally at 10, includes parallely disposed main frame means 11 and 12.

Fixedly secured to the front or spitter end of frames 11 and 12 are upright members 13 and 14, respectively. Fixedly secured between the upper ends of upright members 13 and 14 is forward cross member 15.

Fixedly secured to and extending between main frame means 11 and 12 intermediate their ends is intermediate cross member 16. In the area adjacent the rear or handle end of main frame means 11 and 12 and fixedly secured thereto and extending therebetween are rear cross members 17.

Handles 18 and 19 are boltingly secured to the rear portion of main frames 11 and 12. A brace 20 extends between these handles and is fixedly secured thereto.

A drive means such as motor or engine 21 is mounted on rear cross members 17 in the normal manner of such devices. This motor or engine is of the vertical shaft type with such drive shaft being indicated at 22. This drive shaft, of course, extends below engine 21 and its supporting cross members 17.

Wheel supports 22 and 23 are fixedly secured by weldment or other methods to the central section of main frames means 11 and 12, respectively. Fixedly secured to and extending between the upper portions of wheel supports 23 and 24 is intermediate cross member 16.

Rotatively mounted on the lower portion of wheel supports 23 and 24 are wheels 26 and 27, respectively.

Pivotably mounted on upright member 13 is a support arm 28. Fixedly secured to the outer end of this support arm is telescoping splitting device support and log control leg 29. A quick release lock 30 is provided on telescoping leg 29. Since devices of this type for locking and releasing telescoping members are well known to those skilled in the art, further detailed discussion of the same is not deemed necessary.

A flat plate-like foot 31 is secured to the lower or outer end of leg 29.

A generally vertically disposed shaft 25 is rotatively mounted on the central portion of intermediate cross member 16.

Rotatively mounted to the central portion of forward cross member 15 is log splitting member 32. This splitting member includes a conical shaped log engaging portion 33 which terminates at tip 34 and has helical or spiral grooves 35 on the exterior surface thereof. The log splitting member 32 also includes a sprocket portion 36 which is adapted to have a drive chain 37 trained thereabout.

A sprocket 38 is fixedly secured to intermediate shaft 25 with drive chain 37 trained thereabout.

Figure 3:
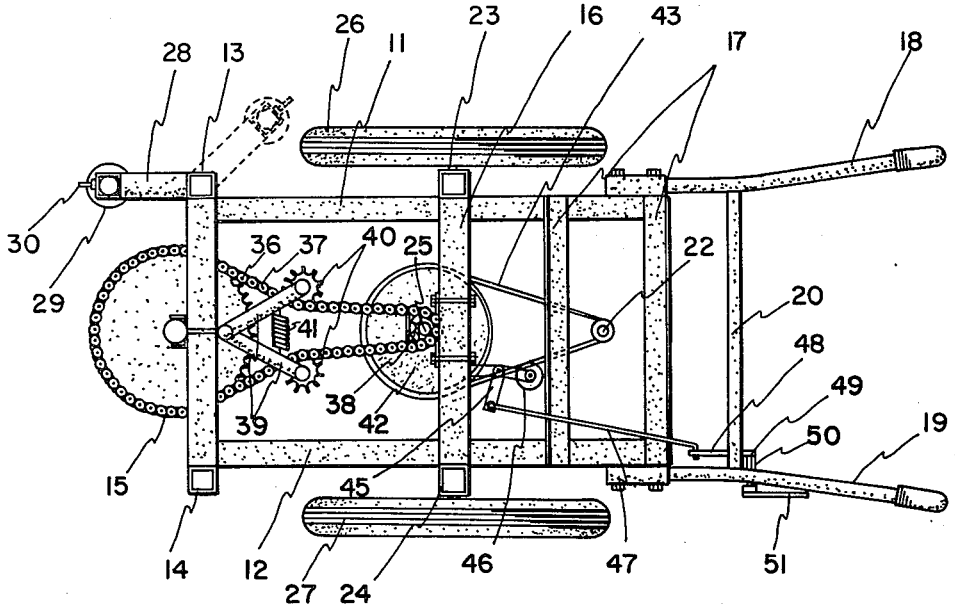
FIG. 3 is a top plan view showing the primary splitting head drive means.

Tension arms 39 are pivotably mounted on forward cross member 15 at one end and rotatively mount tension sprockets 40 on their opposite ends. A tensioning means such as coil spring 41 is provided between the tension arms 39 to keep sprockets 40 in tensioned engagement with drive chain 37 as can be seen particularly clear in FIG. 3.

Fixedly mounted on intermediate shaft 25 above sprocket 38 is a large pulley 42 about which is trained drive belt 43. This drive belt is also trained about pulley 44 which is fixedly mounted to drive shaft 22 of motor 21.

A clutch support bracket 44 is fixedly secured to and extends outwardly from intermediate cross member 16. An L-shaped clutch arm 45 is pivotably mounted at its apex to support bracket 44. One end of clutch arm 45 rotatively mounts clutch pulley 46 with clutch connecting rod 47 being operatively connected to the other end of such arm.

The end of connecting rod 47 opposite its connection to clutch arm 45 is operatively connected to clutch handle arm 48. This handle arm is fixedly secured to shaft 49 which is pivotably mounted on handle 19 through bearing tube 50. Fixedly secured to the end of shaft 49 opposite arm 48 is clutch handle 51.

Figure 4:
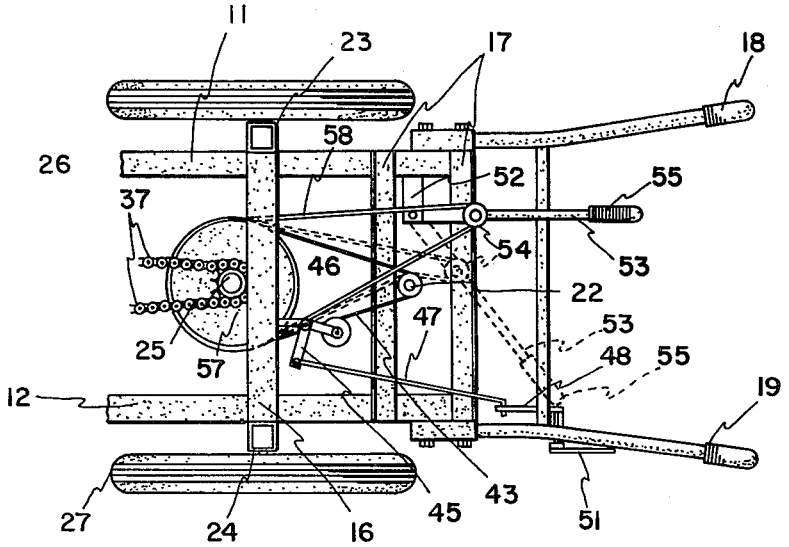
FIG. 4 is a top plan view of the reverse drive means for the splitting head.

As an additional feature, a reverse drive for log splitting member 32 can be provided. This reverse includes a bracket 52 which is fixedly secured to main frame means 11 at one end and pivotably mounts reverse lever 53 at its other end. A pulley 54 is rotatively mounted on reverse lever 53 at a point intermediate its ends as can clearly be seen in FIG. 4. A handle 55 is provided on the end of lever 53 opposite its attachment to bracket 52.

A reversing pulley 56 is fixedly mounted on drive shaft 22 in the same plane as pulley 54 mounted on reverse lever 53. A large reverse pulley 57 is fixedly secured to intermediate shaft 25, again in the same plane as pulleys 56 and 54. A reversing belt 58 is trained about large pulley 57 and lever pulley 54. When reverse handle 55 is moved from its position shown in solid lines in FIG. 4 to the position shown in dotted lines, reversing belt 54 will be pulled into driving contact with motor pulley 56 thus making intermediate shaft 25 turn in the opposite direction from the direction it turns when driven by drive belt 43.

When the reversing belt 58 is in engagement with pulley 56, clutch pulley 46 will, of course, have been already manipulated by clutch handle 51 out of engagement with drive belt 43 thus allowing such belt to slip and not drive shaft 25.

Figure 5:
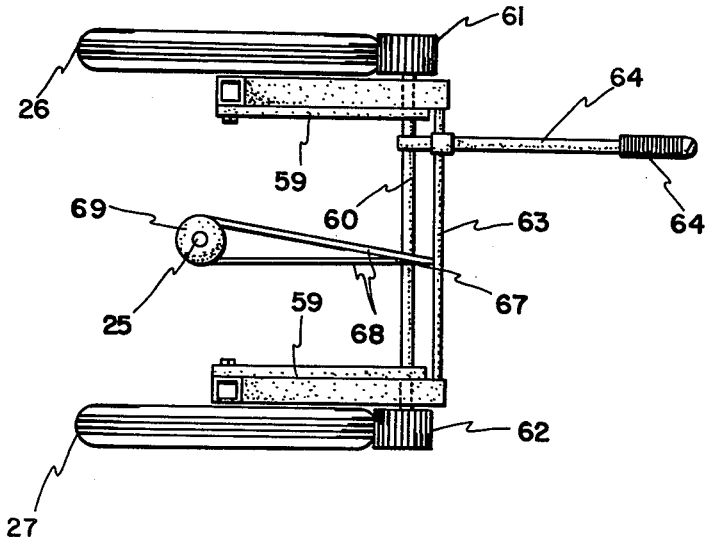
FIG. 5 is a cutaway top plan view of the wheel propulsion drive of the present invention.

Another option or feature which if desired can be included on the log splitting device 10 of the present invention is the self-propelling system shown in FIG. 5. This drive system includes a pair of drive arms 59 which are pivotably attached at one end to wheel supports 23 and 24. The other end of the two drive arms rotatively mount shaft 60. This shaft has fixedly secured at its two ends driving wheels 61 and 62 which are disposed in alignment with support wheels 26 and 27, respectively.

To manipulate wheels 61 and 62 into driving contact with wheels 26 and 27, a pivot shaft 63 is provided which extends between main frames 11 and 12 adjacent the rear portion thereof. A drive engaging handle 64 is pivotably mounted on shaft 63 intermediate its ends and includes a depending bracket portion 65 fixedly secured to its end opposite handle grip 66. The outer end of bracket portion 65 is mounted on rotatable shaft 60. Thus it can be seen that when handle grip 66 is moved downwardly, shaft 60 and its associated drive wheels 61 and 62 will be pushed into drive engagement with support wheels 26 and 27. On the other hand when grip 66 is moved upwardly as shown in FIG. 1, drive wheels 61 and 62 will be pivoted out of contact with support wheels 26 and 27.

To rotate shaft 60, a pulley 67 is fixedly secured thereto and has a propulsion drive belt 68 trained thereover. This belt is in turn trained over pulley 69 which is fixedly secured to shaft 25.

From the above it can be seen that with clutch pulley 46 in driving engagement with drive belt 43, intermediate shaft 25 will turn which in turn will drive drive wheels 61 and 62 through pulley 67 and belt 68. If on the other hand clutch pulley 46 is out of engagement with belt 43 and reversing belt 58 is in engagement with pulley 56 to drive shaft 25 in the opposite direction, then drive wheels 61 and 62 will drive support wheels 26 and 27 in a reverse direction.

When, of course, grip 66 and handle 64 are raised and held in such position by lock bar 70, then drive wheels 61 and 62 will be out of engagement with support reels 26 and 27 and no propulsion power will be transmitted thereto. The lock bar 70 is, of course, necessary to prevent accidental engagement of the propulsion system. This bar is fixedly secured to handle 18. Since devices of this type are well known to those skilled in the art, further detailed description of the same is not deemed necessary.

The forward and reverse drives for intermediate shaft 25 have been hereinabove discussed in detail. Once this shaft 25 is rotated in either forward or reverse direction, this will drive log splitting member 32 in either the forward or reverse direction through the interconnection by drive chain 37 and its associated sprockets.

A removable handle 71 is provided which will fit over the upper end of shaft 25 as can clearly be seen in FIG. 1. The purpose of this crank handle is to allow the log splitting member 32 to be manipulated even though it becomes stuck in a log or for removing the same from a log for example after running out of gas.

To use the improved log splitting device of the present invention, the same is moved either manually or through engagement of the self-propelling system to a position wherein the log splitting member 32 is disposed over the log to be split which is laying on the ground. This log can either be straddled or the splitting device can be sitting off to the side. In any case the quick release lock on the telescoping leg 29 is released and the support arm 28 is maneuvered so that it is against the log to be split. The purpose of this is to prevent the log from simply turning around as the log splitting member 32 engages the same.

Once the improved log splitting device 10 is in position as hereinabove described, motor 21 is started and clutch pulley 46 is manipulated into engagement with drive belt 43. Through shaft 25, this drives the log splitting member 32 in a clockwise direction as shown in the drawings. As handles 18 and 19 are raised, the tip 34 of the splitting member 32 will engage the log 72. The spiraled grooves 35 will then take hold and the log engaging portion 33 will screw itself into the log 72 until the same splits open.

Two half logs are now lying on the ground and with simple manipulation of handles 18 and 19, the tip 34 of the log engaging portion 33 of the log splitting member 32 can be placed in the center thereof and such half logs can be split into quarter logs. These quarter logs, which normally are of a usable size, can then be loaded onto a trailer or other desired means of conveyance (not shown). Thus it can be seen that with only the slight effort required in manipulating the log splitting device of the present invention into position with the log splitting member adjacent the log to be split, such log can be reduced to at least quarter size and then, with much less effort than is required to lift a whole log, placed into a trailer or other conveyance means.

Due to the large size of the wheels 26 and 27, the device of the present invention can be readily removed over rough terrain as well as over limbs and other debris with minimum effort.

Figure 2:
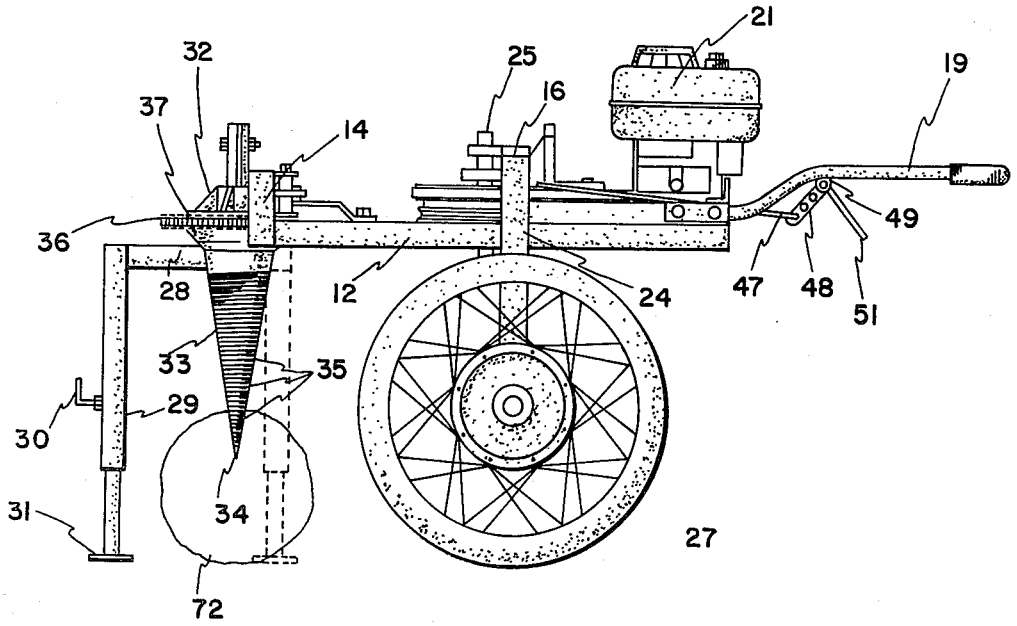
FIG. 2 is a side elevational view of a simplified form of the present invention.

Once the splitting function has been completed and the splitting device of the present invention is no longer to be used, the quick release lock 30 can be manipulated to lock the telescoping portion of leg 29 in down position allowing the same to act as a support stand as shown in FIGS. 1 and 2.

From the above it can be seen that the improved log splitting device of the present invention eliminates the necessity of loading whole logs prior to splitting the same. The device of the present invention also can be readily maneuvered in the field adjacent the cut up logs and then can readily split the same where they lie. On occasion the device of the present invention can simply straddle the logs where they lie and taking one at a time, can split the whole length of the tree.

The log splitting device of the present invention is relatively inexpensive to manufacture, is highly efficient in operation as well as saving considerable time and effort in the rendering of whole logs into usable firewood.

The terms such as "upper", "lower", "front", "rear", and so forth are used herein merely for convenience to describe the improved log splitting device and its parts as oriented in the drawings. It is to be understood, however, that these terms are in no way limiting to the invention since the device may obviously be disposed in different orientations when in use.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. An improved log splitting device comprising: a propulsion means; a screw type log splitting means operatively connected to said propulsion means; means for movably supporting said propulsion means and its associated log splitting means relative to the ground; means operatively connecting said propulsion means to said supporting means for driving such supporting means and handle means for manually manipulating said log splitting device during the splitting process whereby an improved log splitter is provided.

2. The device of claim 1 wherein the means for movably supporting said propulsion means and its associated log splitter means relative to the ground is at least one wheel.

3. The device of claim 1 wherein the means for movably supporting said propulsion means and its associated log splitter means relative to the ground is at least a pair of wheels.

4. The device of claim 1 wherein said propulsion means is a gasoline type motor.

5. The device of claim 1 wherein said propulsion means is a diesel motor.

6. The device of claim 1 wherein said propulsion means is operatively connected to said splitting means through the use of at least one chain and sprocket drive.

7. The device of claim 1 wherein said propulsion means is operatively connected to said splitting means through the use of at least one belt and pulley drive.

8. The device of claim 1 wherein said propulsion means is operatively connected to said splitting means through the use of combination of sprocket and chain, and belt and pulley drives.

9. The device of claim 1 wherein said propulsion means rotates said log splitting means.

10. The device of claim 9 wherein a means to reverse the rotation of said log splitting means is provided.

11. The device of claim 1 wherein a log engaging and steadying means is connectingly associated with said log splitting device.

12. An improved log splitting device comprising: propulsion means; a screw type log splitting means operatively connected to said propulsion means; an emergency supplemental propulsion means operatively associated with said log splitting means; means for movably supporting said propulsion means and its associated log splitting means relative to the ground; and handle means for manually manipulating said log splitting device during the splitting process whereby an improved lot splitter is provided.

13. The device of claim 12 wherein said emergency means is a removable handle.

* * * * *